US005248209A

United States Patent [19]

Isobe

[11] Patent Number: 5,248,209

[45] Date of Patent: Sep. 28, 1993

[54] COLOR INK RIBBON AND SERIAL COLOR PRINTER USING THE SAME

[75] Inventor: Minoru Isobe, Tokyo, Japan

[73] Assignee: Oki Electric Industry Co., Ltd., Tokyo, Japan

[21] Appl. No.: 898,091

[22] Filed: Jun. 12, 1992

[30] Foreign Application Priority Data

Jun. 19, 1991 [JP] Japan ..... 3-147580

[51] Int. Cl.[5] ..... B41J 31/00

[52] U.S. Cl. ..... 400/240.3; 400/120; 400/240.4

[58] Field of Search ..... 400/120 HH, 88, 240.3, 400/240.4

[56] References Cited

U.S. PATENT DOCUMENTS

| | | | |
|---|---|---|---|
| 4,638,320 | 1/1987 | Watanabe | 400/240.4 |
| 4,735,519 | 4/1988 | Tanaka | 400/240.3 |

FOREIGN PATENT DOCUMENTS

| | | | |
|---|---|---|---|
| 025660 | 2/1988 | Europe | 400/240.3 |
| 0179405 | 4/1986 | Europe | 400/240.3 |
| 58-7390 | 1/1983 | Japan | 400/240.3 |
| 58-187395 | 11/1983 | Japan | 400/240.3 |
| 61-102557 | 6/1986 | Japan | 400/240.3 |
| 1-56678 | 11/1989 | Japan | 400/240.3 |
| 2-4565 | 1/1990 | Japan | 400/240.3 |

OTHER PUBLICATIONS

Patent Abstracts of Japan, Vol. 8, No. 28 (M-274)(1465) February 7th, 1984.

Patent Abstracts of Japan, Vol. 10, No. 291 (M522)(2347), October 3rd, 1986.

*Primary Examiner*—David A. Wiecking

*Assistant Examiner*—Steven S. Kelley

*Attorney, Agent, or Firm*—Spencer, Frank & Schneider

[57] ABSTRACT

A color ink ribbon has a plurality of color areas and a plurality of black areas alternatively arranged on the ribbon in longitudinal direction thereof and each having a length greater than the width of the ribbon. The color areas are each subdivided in width into a plurality of strip-like areas each being impregnated with or coated with ink of particular color, i.e., yellow, magenta or cyan. The black areas are each impregnated with or coated with black ink over the entire width thereof. A color printer using the ribbon has a print head provided with heating elements which are arranged on an area corresponding to the entire width of the ribbon. The black areas of the ribbon are provided with a greater width than the color areas, so that black image data may be printed out continuously or on a plurality of lines at a time without the ribbon being fed.

8 Claims, 10 Drawing Sheets

Fig. 6

| L | R1 | R2 | R3 | R4 | R5 |
|---|---|---|---|---|---|
| 1 | 1 | 0 | 0 | 0 | 0 |
| 2 | 1 | 1 | 0 | 0 | 0 |
| 3 | 1 | 1 | 1 | 0 | 0 |
| 4 | 1 | 1 | 1 | 1 | 0 |
| 5 | 1 | 1 | 1 | 1 | 1 |
| ⋮ | ⋮ | ⋮ | ⋮ | ⋮ | ⋮ |
| N | 1 | 1 | 1 | 1 | 1 |
| N+1 | 0 | 1 | 1 | 1 | 1 |
| N+2 | 0 | 0 | 1 | 1 | 1 |
| N+3 | 0 | 0 | 0 | 1 | 1 |
| N+4 | 0 | 0 | 0 | 0 | 0 |

9

COLOR INK RIBBON AND SERIAL COLOR PRINTER USING THE SAME

BACKGROUND OF THE INVENTION

1. Field of the Invention

The present invention relates to a color ink ribbon and a serial color printer using the same.

2. Description of the Prior Art

Some different kinds of color ink ribbons have been proposed in the past for use with a serial color printer. A first type of ribbon has a black area, cyan area, yellow area and magenta area which are arranged one after another along the length of the ribbon and each having a length greater than the width of a sheet, or spacing width, as disclosed in Japanese Patent Laid-Open Publication No. 4565/1990. A second type of ribbon is subdivided in width into four subareas each being assigned to one of cyan, yellow, and magenta ink, as proposed in Japanese Patent Publication No. 56678/1989. A third type of ribbon is divided into an upper area assigned to black and a lower area in which a yellow, magenta and cyan subareas are arranged one after another along the length of the ribbon, as taught in Japanese Utility Model Laid-Open Publication No. 102557/1989.

The first type of ribbon has a problem that it cannot print out a color image unless transported three consecutive times consuming a substantial period of time, slowing down the printing operation. Another problem is that such a ribbon cannot be efficiently used since the black areas which are usually used more frequency than the color areas have smaller dimensions than the color areas. The second type of ribbon promotes more rapid printing than the first type of ribbon. However, this type of ribbon has various problems left unsolved. Specifically, since a thermal head applicable to such a ribbon has heating elements covering only one color, the ribbon has to be shifted every time the head prints out image data in one color and, therefore, needs a complicated shifting mechanism. The ribbon prints out black image data by superposing three different colors, not only wasting time but also failing to render an image in pure black. In light of this, the ribbon may be provided with an additional area for black, and use may be made of a thermal head having heating elements covering all the four colors. Although such an implementation may enhance high speed color printing, it cannot speed up black printing since, among the heating elements covering the four colors, only the elements assigned to black can be used. In addition, this type of ribbon, like the first type of ribbon, cannot be efficiently used since the black areas thereof have smaller dimensions than the color areas. The third type of ribbon can be used more efficiently than the others since it assigns a broader dimensions to black areas which are used more frequently than the others. However, the printing speed available with this type of ribbon is low when it comes to a color printing, as with the first type of ribbon.

SUMMARY OF THE INVENTION

It is therefore an object of the present invention to provide a color ink ribbon capable of printing image data in all the colors at high speed without being fed, and a color printer using the same.

It is another object of the present invention to provide a color ink ribbon capable of printing image data in black continuously or on a plurality of lines at a time without being fed to thereby enhance high speed printing, and a color printer using the same.

In accordance with the present invention, a color ink ribbon for a color printer has a plurality of color areas and a plurality of black areas alternating with each other along the length of the ribbon, and each having a length greater than the width of a sheet to be used. The color areas are each subdivided into a plurality of strip-like areas each being impregnated with or coated with ink of particular color. The black areas are each implemented with or coated with black ink over the entire width thereof.

Also, in accordance with the present invention, a color printer for printing an image on a sheet has a color ink ribbon having a plurality of color areas and a plurality of black areas alternating with each other along the length of the ribbon, and each having a length greater than the width of the sheet. The color areas are each subdivided in width into a plurality of strip-like areas each being impregnated with or coated with ink of particular color. The black areas are each impregnated with or coated with black ink over the entire width thereof. A print head has heating elements arranged over the entire width of the ribbon. A control circuit selectively drives the heating elements of the print head in response to image data fed from a host while spacing the print head to thereby transfer any of the ink from the ribbon to the sheet.

BRIEF DESCRIPTION OF THE DRAWINGS

The objects and features of the present invention will become more apparent from the consideration of the following detailed description taken in conjunction with the accompanying drawings in which:

FIG. 6 shows specific transitions of the contents of a history register which is included in the control circuitry.

DESCRIPTION OF THE PREFERRED EMBODIMENTS

Figure 1:
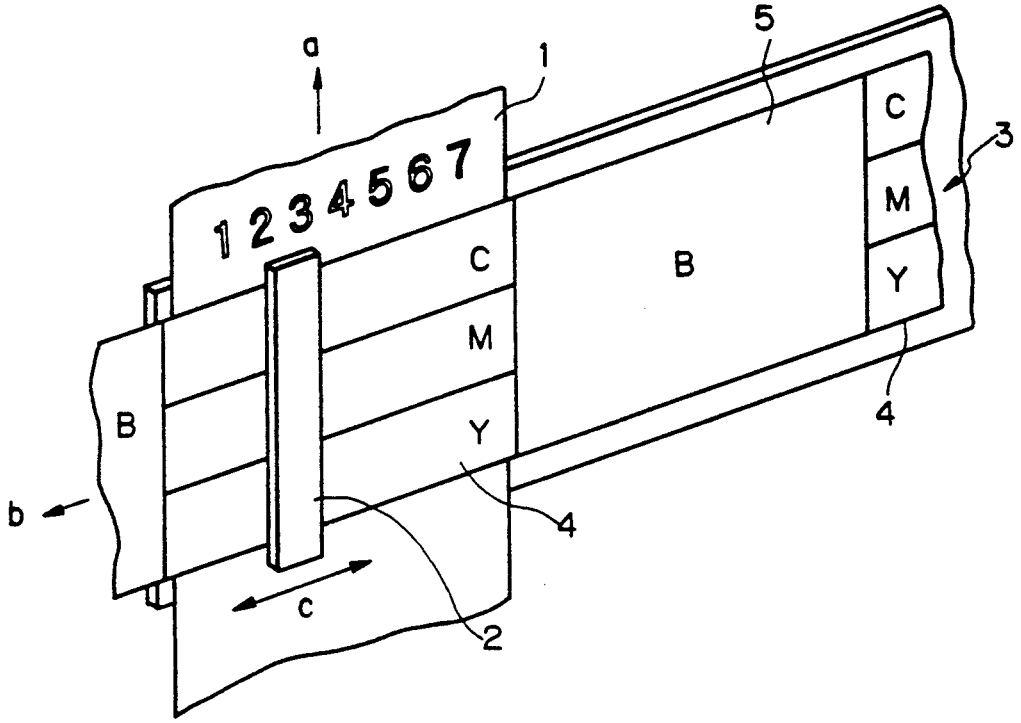
FIG. 1 is a fragmentary perspective view of a color printer embodying the present invention.

Referring to FIG. 1 of the drawings, a color printer with a color ink ribbon embodying the present invention is shown. As shown, the color printer includes a thermal head 2 having heating elements, not shown, arranged in five rows. A color ink ribbon 3 intervenes between the thermal head 2 and a recording medium in the form of a web or sheet 1. The ribbon 3 has thereon a plurality of color areas 4 and a plurality of black area 5 alternating with each other along the length of the ribbon 3. The color areas 4 and black areas 5 each has a length greater than the width of the sheet 3. The color areas 4 are each subdivided into three strip-like areas in the widthwise direction of the ribbon 3 such that each strip covers two lines of the ribbon 3, i.e., a distance d. Cyan (C), magenta (M) and yellow (Y) ink which are thermally fusible or thermally sublimable are respectively applied to the three strips of each color area 4. Thermally fusible or thermally sublimable black ink is applied to each black area (B) 5 over the entire width thereof, i.e., over six lines of the ribbon 3.

Figure 2:
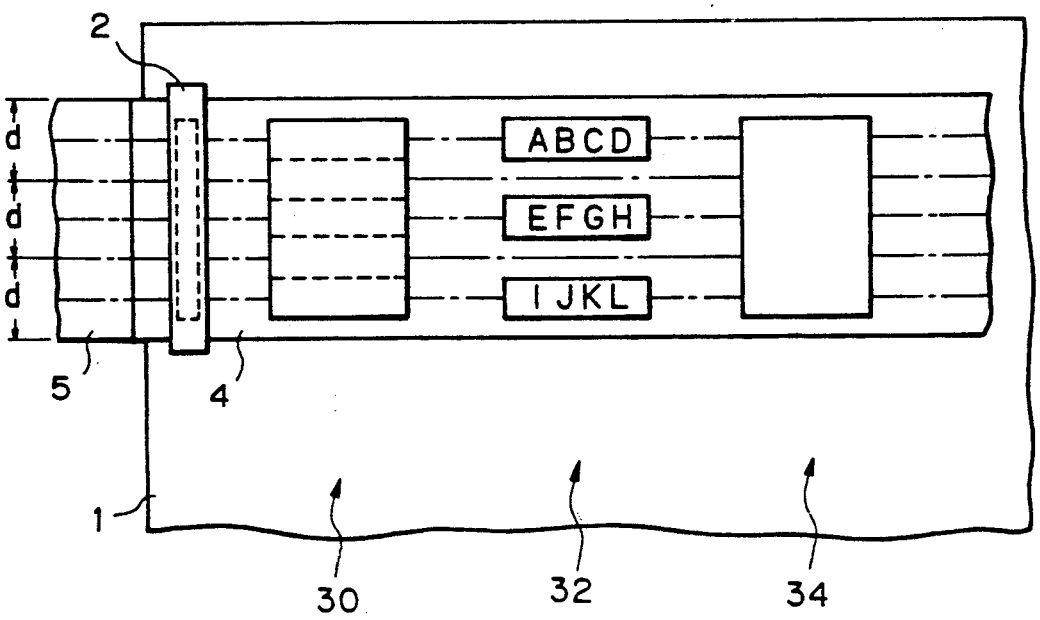
FIG. 2 shows specific graphic and text image patterns which may be printed out on a sheet by the embodiment.

As shown in FIG. 2, the color printer is basically capable of printing a graphic image or a text image in any one of first to third patterns 30, 32 and 34. The first to third patterns 30-34 are respectively representative of a color graphic printing, a color text printing, and a monochromatic or black graphic or text printing. Let the text image be an alphanumeric image by way of example, as illustrated.

Color graphic printing in the first pattern 30 differs from color text printing, which will be described, as to the distance for the sheet 1 to be fed and the heating elements of the head 2 to be driven. Regarding color text printing, the alphanumeric characters on nearby lines are assumed to be spaced apart by 1/5 inch or 1/6 inch. Specifically, to print out a composite color graphic image in yellow, magenta and cyan on the sheet 1, the sheet 1 is fed four times stepwise by each distance of d/2 (corresponding to one line), as the pattern 30 indicates. The direction in which the sheet 1 is fed is indicated by an arrow a in the figure. During this mode operation, the ribbon 3 does not have to be shifted up and down. On the other hand, assume a color text printing represented by the pattern 32 in which the distance between nearby lines is limited, as stated above. Then, since the three strips C, M and Y of the color area 4 each has a width substantially equal to the line feed distance d of alphanumeric characters (corresponding to two lines), after yellow image data has been printed on the sheet, the sheet 1 should only be fed twice in the direction a in completing a color text printing. When the color alphanumeric characters are unusually large size, they may be printed on the sheet 1 in the pattern 30 assigned to a color graphic printing. A monochromactic or black graphic or text image is printed on the sheet 1 by the head 2 by a single or some consecutive operations without the ribbon 3 or the sheet 1 being fed, as the pattern 34 indicates. This is because the head 2 covers the entire width of the black area 5 of the ribbon 2.

In the illustrative embodiment, a color graphic image is printed on the sheet 12 in the first pattern 30 by the following procedure. First, the ribbon 3 is transported in a direction b, FIG. 1, perpendicular to the sheet feed direction a, until a color area 4 thereof faces the sheet 1. Then, the sheet 1 is fed in the direction a to position the first line thereof in front of the yellow strip Y of the color area 4. In this condition, the heating elements arranged on the lowermost or first row of the head 2 are driven in response to yellow image data of the first line fed from a host while the head 2 itself is sequentially moved or spaced in a direction indicated by a double-headed c, FIG. 1. As a result, the image data is printed out in yellow on the first line of the sheet 1. Subsequently, the ribbon 3 is fed again in the direction b until the next color area 4 thereof faces the sheet 1, and then the sheet 1 is fed by one line in the direction a to locate the second line thereof in register with the yellow strip Y of the new color area 4. The heating elements on the lowermost or first row of the head 2 are again selectively driven in response to yellow image data of the second line with the result that image data is printed out in yellow on the second line of the sheet 1. By the procedure described so far, yellow image data are printed out on the first and second lines of the sheet 1.

Thereafter, the ribbon 3 is fed in the direction b to position another fresh color area 4 in front of the sheet 1, and then the sheet 1 is further fed in the direction a by one line. In this condition, the head 2 is spaced in the direction c where having the heating elements on the third row thereof selectively driven in response to magenta image data of the first line fed from the host. At the same time, the heating elements on the first or lowermost row of the head 2, which now face the third line of the sheet 1, are selectively driven in response to yellow image data. As a result, magenta data is printed on the first line of the sheet 1 over the yellow image existing there, while yellow data is printed on the third line of the sheet 1. Subsequently, the ribbon 3 is further transported in the direction b to locate the subsequent color 4 in front of the sheet 1, and then the sheet 1 is fed in the direction a by one line. Then, the head 2 has the heating elements on the third row thereof selectively driven in response to magenta image data of the second line, while having the heating elements on the first row driven in response to yellow image data of the fourth line. As a result, magenta data is printed on the second line of the sheet 1 above the yellow image existing there, and yellow data is printed on the fourth line.

Thereupon, the ribbon 3 is further paid out in the direction b to bring the next color area 4 thereof to the position facing the sheet 1, and then the sheet 1 is fed in the direction a by one line. At this instant, the head 2 has the heating elements on the fifth or uppermost row thereof selectively driven in response to cyan image data of the first line, has the heating elements on the third row selectively driven in response to magenta image data of the third line, and has the heating elements on the first row selectively driven in response to yellow image data of the fifth line. Consequently, cyan data is printed on the first line of the sheet 1 over the composite yellow and magenta image existing there, magenta data is printed on the third line, and yellow data is printed on the fifth line.

By the above-described procedure, yellow, magenta and cyan image data are sequentially printed on the first line of the sheet 1 one above another. Thereafter, every time the ribbon 3 is fed in the direction b to bring a new color area 4 into register with the sheet 1 and the sheet 1 is fed in the direction a one line, the heating elements on the first, third and fifth rows of the head 2 are driven at the same time in response to image data of associated colors. This is successful in effecting color printing on a line basis. After yellow data has been printed out on the last line of the sheet 1, the ribbon 3 and sheet 1 will be further fed four consecutive times each to thereby complete a single color printing.

To print a graphic image in black, the ribbon 3 is paid out until a black area 5 thereof faces the sheet 1. In this condition, the sheet 1 is fed to bring the first line thereof into register with the heating elements on the fifth row of the head 2. Subsequently, the head 2 is spaced while having all the heating elements on the first to fifth rows thereof driven in response to five lines of black data. On the completion of the print-out of such five lines of black data, the ribbon 3 is transported to bring the next black area 5 to the position in front of the sheet 1 while the sheet 1 is fed by five lines. Then, the head 2 is again spaced while having the heating elements on the first to fifth rows thereof driven in response to another five lines of black data. In this manner, five lines of graphic image are printed out in black at the same time with the ribbon 3 fed only once. In the case of a black text image, three lines of image data will be printed out on the sheet 1 at a time.

So long as the color area 4 and black area 5 of the ribbon 3 have the same length, they can be accurately positioned in front of the sheet 1 if the ribbon 3 is exactly transported by a distance corresponding to the length. To enhance the accurate positioning of the areas 4 and 5, a strip of foil may be adhered to the boundary between the adjoining areas 4 and 5 to reflect light emitted from a light emitting element. Then, the transport of the ribbon 3 will be controlled in response to the output of a light-sensitive element to which a reflection from the foil, i.e., boundary between the areas 4 and 5 will be incident. Alternatively, the ribbon 3 may be locally perforated to allow light issuing from a light emitting element to reach a light-sensitive element therethrough. This is also successful in detecting the boundary between the areas 4 and 5 with accuracy. Further, the difference in reflectance between the area 4, preferably the yellow strip Y thereof, and the area 5 may be detected by a light-sensitive element so as to position the areas 4 and 5 with accuracy.

While the embodiment uses thermally fusible ink, it may alternatively use ink having a multi-printing capability, i.e., capable of being repetitively used several times. With this kind of ink, it is possible to omit the first five times of ribbon feed and the last five times of ribbon feed to thereby reduce the period of time which would be consumed by the ribbon feed. If desired, the multi-printing ink may be implemented by oil ink, in which case a wire dot print head will advantageously be used.

Figure 3:
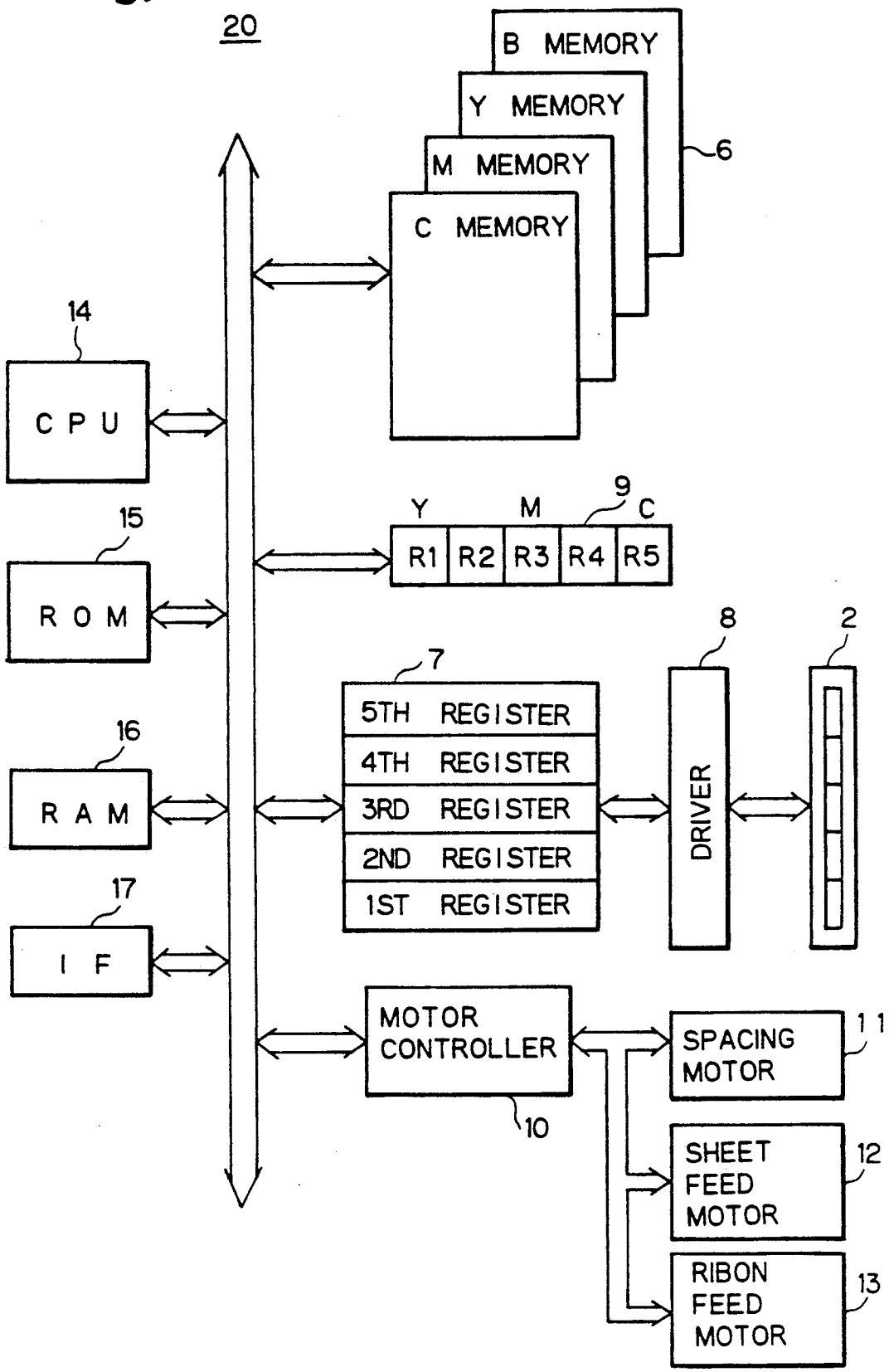
FIG. 3 is a block diagram schematically showing control circuitry incorporated in the embodiment.

Referring to FIG. 3, a control circuit incorporated in a thermal transfer color printer operable with the above-described color ink ribbon 3 will be described. As shown, the control circuit, generally 20, has a data memory 6 made up of a black (B) memory, a yellow (Y) memory, a magenta (M) memory, and a cyan (C) memory for storing black, yellow, magenta and cyan image data, respectively. A buffer register 7 consists of first to fifth registers each being capable of storing one line of image data. A driver 8 selectively drives the heating elements of the thermal head 2 in response to image data fed from a host, not shown. A history register 9 is implemented as a 5-bit shift register having a first to a fifth bit R1–R5. A motor controller 11 controls a spacing motor 11, a sheet feed motor 12, and a ribbon feed motor 13. A CPU (Central Processing Unit) 14 controls the operations of the entire printer. A ROM (Read Only Memory) 15 stores programs to be executed by the CPU 14. A RAM (Random Access Memory) 16 is used to store various parameters including the output of a line counter. An interface (IF) 17 receives image data from the host and allows them to be written to the data memory 6.

A reference will be made to FIGS. 4A, 4B, 5A and 5B for describing specific operations of the control circuit, i.e., CPU 14 shown in FIG. 3. FIGS. 4A and 4B and FIGS. 5A and 5B pertain to a color printing and a black printing, respectively. A reference will also be made to FIG. 6 demonstrating specific transitions of the contents of the history register 6.

Figure 4A:
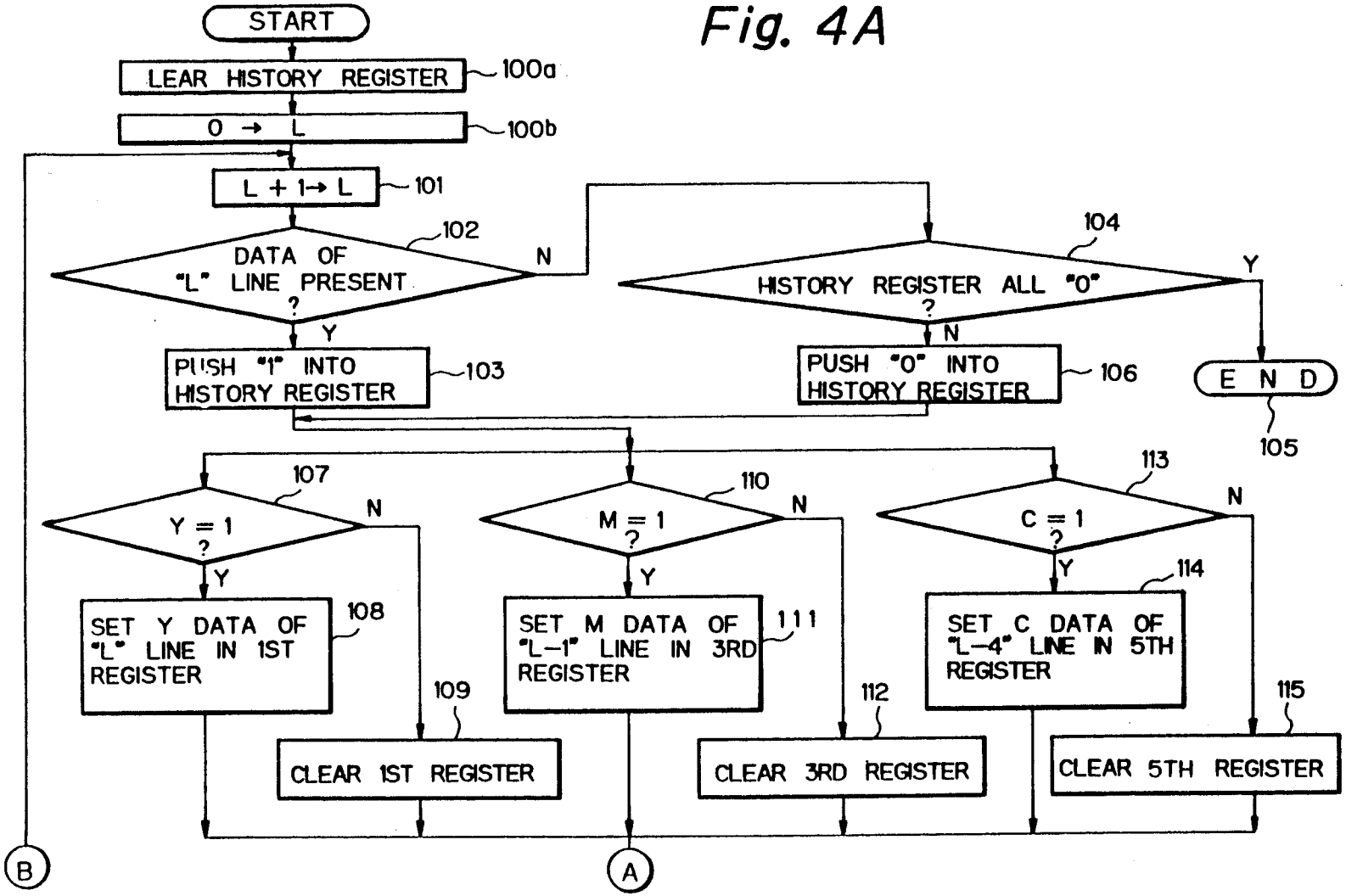
FIGS. 4A and 4B are flowcharts demonstrating a specific color printing procedure to be executed by the control circuitry.

In the event of color printing, the CPU 14 clears the history register 9 and changes the content L of a line counter, which is implemented by the RAM 16, to zero (step 100, FIG. 4A). Then, the CPU 14 increments the resulting content L of the line counter by 1 (101, FIG. 4A) and determines whether or not image data on the "L" line indicated by the line counter is present (102, FIG. 4A). If such data is present, the CPU 14 pushes logical "1" into the history register 9, i.e., write "1" in the history register 9 while shifting the register 9 (103, FIG. 4A). If the data of interest is absent, the CPU 14 checks the history register 9 to see if all the bits thereof are logical "0" (104, FIG. 4A). If all the bits of the history register 9 are "0", the program ends; if otherwise, the CPU 14 pushes "0" into the history register 9 (106, FIG. 4A). Therefore, at the beginning of printing, for example, the history register 9 has "1" only in the first bit R1, or Y bit, and "0" in all the other bits R2–R5 since image data is present on the first line. Subsequently, the CPU 14 scans the history register 9 and, if the first bit R1 is "1" (107, FIG. 4A), reads yellow image data on the "L" line out of the data memory 6 to set it in the first register of the buffer register 7 (108, FIG. 4A). If the first bit R1 of the history register 9 is "0", the CPU 14 clears the first register. If the third bit R3, or M bit, of the history register 9 is "1" (110, FIG. 4A), the CPU 14 reads magenta image data on the "L-2" line out of the data memory 6 and sets it in the third register of the buffer register 7 (111, FIG. 4A). If the bit R3 is "0", the CPU 14 clears the third register (112, FIG. 4A). Further, if the fifth bit R5, or C bit, is "1" (113, FIG. 4A), the CPU 14 reads cyan data on the "L-4" line out of the data memory 6 and sets it in the fifth register (114, FIG. 4A); if the fifth bit R5 is "0", the CPU 14 clears the fifth register (115, FIG. 4A). Hence, assuming that the line number is 1 and that only the first bit R1 of the history register 9 is "1", yellow image data on the first line is set in the first register of the buffer register 7 while the third and fifth registers are cleared.

Figure 4B:
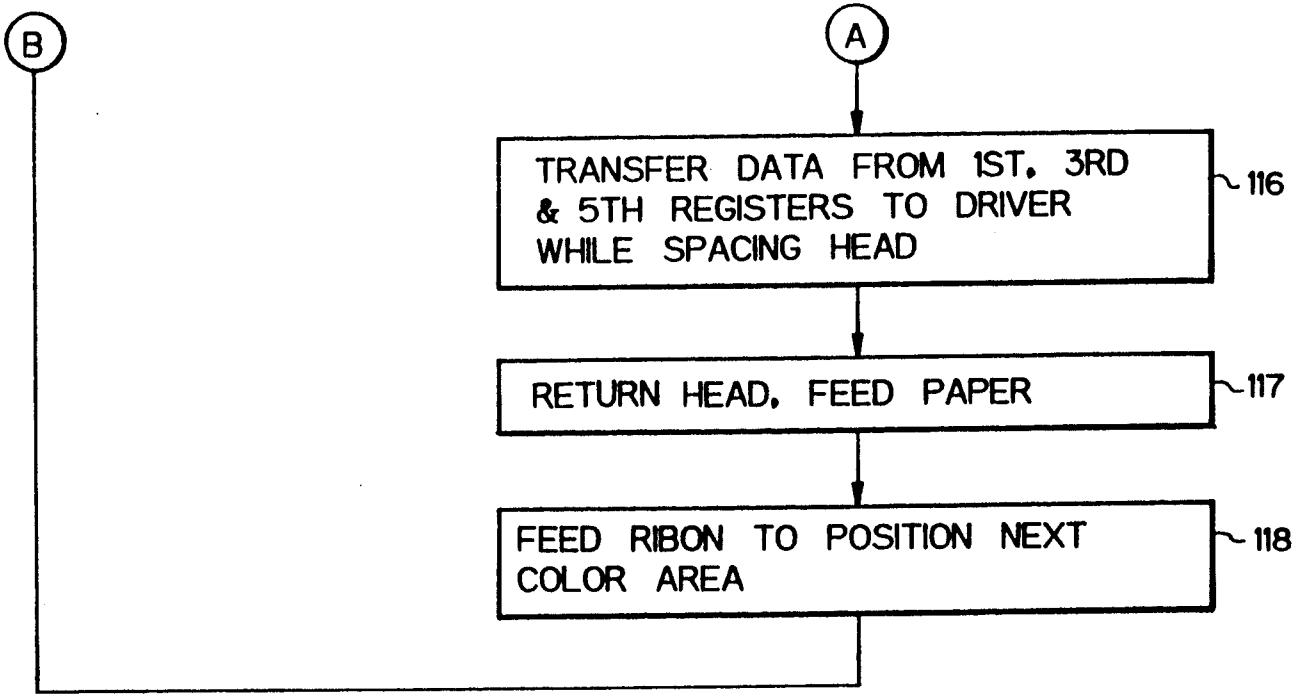

Thereafter, the CPU 14 causes the motor controller 10 to drive the spacing motor 11 while transferring the contents of the first, third and fifth registers of the buffer register 7 to the driver 8 (116, FIG. 4B). The driver 8, therefore, selectively drives the heating elements of the thermal head 2 according to the contents of the registers while the head 2 is being spaced in the direction c. At this instant, only the heating elements on the first row of the head 2 are driven since image data is present only in the first register of the buffer register 7, whereby only yellow image data is printed on the sheet 1.

Subsequently, the CPU 14 causes the motor controller 10 to drive the spacing motor 11, sheet feed motor 12 and ribbon feed motor 13. As a result, the head 2 is returned to the home position thereof, the sheet 1 is fed by one line, and the ribbon 3 is transported over a distance double the width of the sheet 1, i.e., until the next color area 4 arrives at the sheet 1 (118, FIG. 4B). Then, the program returns to the step 100 to repeat the above-described sequence of steps. Assuming that image data is present on N consecutive lines, the contents of the history register 9 change as shown in FIG. 6 specifically. As shown, when the line number is 1, the contents of the first to fifth bits R1–R5 of the history register 9 are "1, 0, 0, 0, 0", so that only yellow image data is printed on the first line of the sheet 1. When the line number is 2, the contents of the bits R1–R5 of the history register 9 are "1, 1, 0, 0, 0" with the result that only yellow image data is printed on the second line of the sheet 1. When the line number is 3, the contents of the bits R1–R5 are "1, 1, 1, 0, 0". At this time, yellow image data is printed on the third line of the sheet 1 while magenta image data is printed on the first line over the yellow image having been printed out. When the line number L is 4, the contents of the bits R1-R5 are "1, 1, 1, 1, 0". Hence, yellow image data is printed on the fourth line of the sheet 1 while magenta image data is printed on the second line over the yellow image having been printed out.

When the line number is 5, the bits R1-R5 of the history register 9 are "1, 1, 1, 1, 1". At this instant, yellow image data is printed on the fifth line of the sheet 1, magenta image data is printed on the third line over the yellow image existing there, and cyan data is printed on the first line over the composite yellow and magenta image existing there. As a result, image data is printed out in color on the first line of the sheet 1. Thereafter, the bits R1-R5 of the history register 9 remain in "1, 1, 1, 1, 1" until the line number L coincides with N, so that image data are sequentially printed out on the sheet 1 in color line by line. When the line number reaches N+1, the bits R1-R5 of the history register 9 change to "0, 1, 1, 1, 1". Therefore, magenta image data is printed on the "N−1" line over the yellow image existing there while cyan image data is printed on the "N−3" line over the composite yellow and magenta image existing there. On the increase of the line number L to N+2, the bits R1-R5 of the history register 9 change to "0, 0, 1, 1, 1" with the result that magenta image data is printed on the "N" line over the yellow image while cyan image data is printed on the "N−2" line over the composite yellow and magenta image. When the line number L is N+3, the bits R1-R5 of the history register 9 are "0, 0, 0, 1, 1" and, therefore, cyan image data is printed on the "N−1" line over the composite yellow magenta image. As the line number L reaches N+4, the bits R1-R4 of the history register 9 change to "0, 0, 0, 0, 1" with the result that cyan image data is printed on the "N" line over the composite yellow and magenta image having been formed there. Consequently, a complete color image is formed over N lines on the sheet 1. On the increment of the line number L to N+5, the bits R1-R5 of the history register 9 change to "0, 0, 0, 0, 0". Then, since no image data exists on the next line and since all the contents of the history register 9 all are "0", the sequence of printing operation ends.

It will be seen from the above that in the case of a color printing the history register 9 stores lines where image data has been printed in yellow as a history and thereby allows magenta and cyan image data to be set in the respective registers.

Figure 5A:
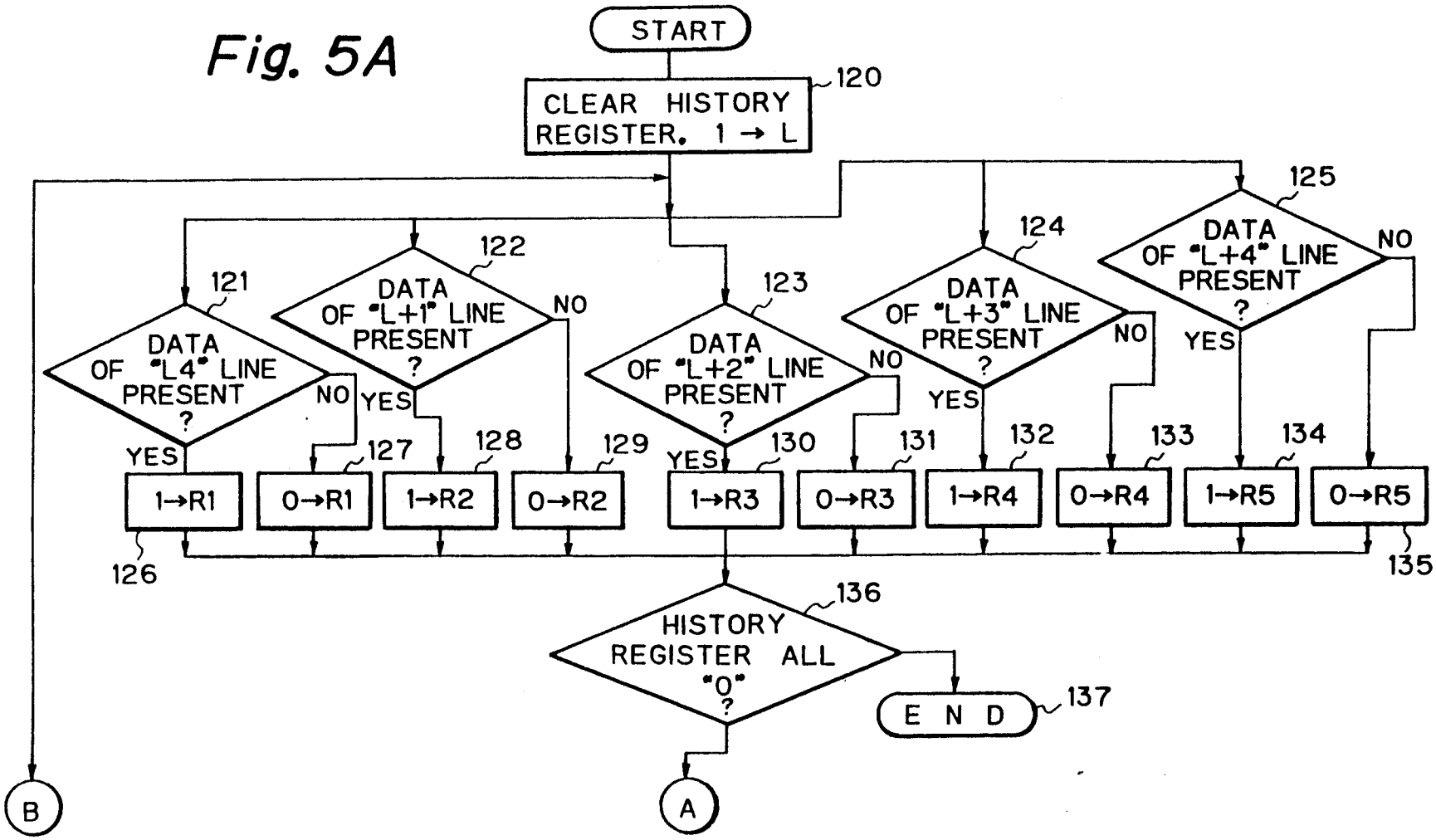
FIGS. 5A, 5B and 5C are flowcharts representative of a specific black printing operation to be also executed by the control circuitry.

How the embodiment prints out a black image on the sheet 1 will be described with reference to FIGS. 5A, 5B and 5C. First, the CPU 14 clears the history register 9 and increments the line counter to L (120, FIG. 5A). Based on the content L of the line counter, the CPU 14 determines whether or not image data exists on the "L" line (121, FIG. 5A), "L+1" line (122, FIG. 5A), "L+2" line (123, FIG. 5A), "L+3" line (124, FIG. 5A), and "L+4" line (125, FIG. 5A). The CPU 14 changes the first bit R1 of the history register 9 to "1" (126, FIG. 5A) if image data is present on the "L" line or holds "0" therein (127, FIG. 5A) if otherwise. Likewise, the CPU 14 changes the second bit R2 of the history register 9 to "1" (128, FIG. 5A) if image data is present on the "L+1" line or holds "0" therein (129, FIG. 5A) if otherwise. The CPU 14 changes the third bit R3 to "1" (130, FIG. 5A) if image data is present on the "L+2" line or holds "0" therein (131, FIG. 5A) if otherwise. Regarding the "L+3" line, the CPU changes the fourth bit R4 to "1" (132, FIG. 5A) if image data is present or holds "0" therein (133, FIG. 5A) if otherwise. Further, as for the "L+4" line, the CPU 14 changes the fifth bit R5 to "1" (134, FIG. 5A) if image data is present or holds "0" (135, FIG. 5A) if otherwise. Thereafter, the CPU 14 checks the history register 9 to see if all the bits thereof are "0" (136, FIG. 5A). If the answer of the step 136 is NO, the CPU 14 ends the program. If the answer of the step 136 is YES, the CPU 14 executes the sequence of steps shown in FIGS. 5B and 5C, as follows.

Figure 5B:
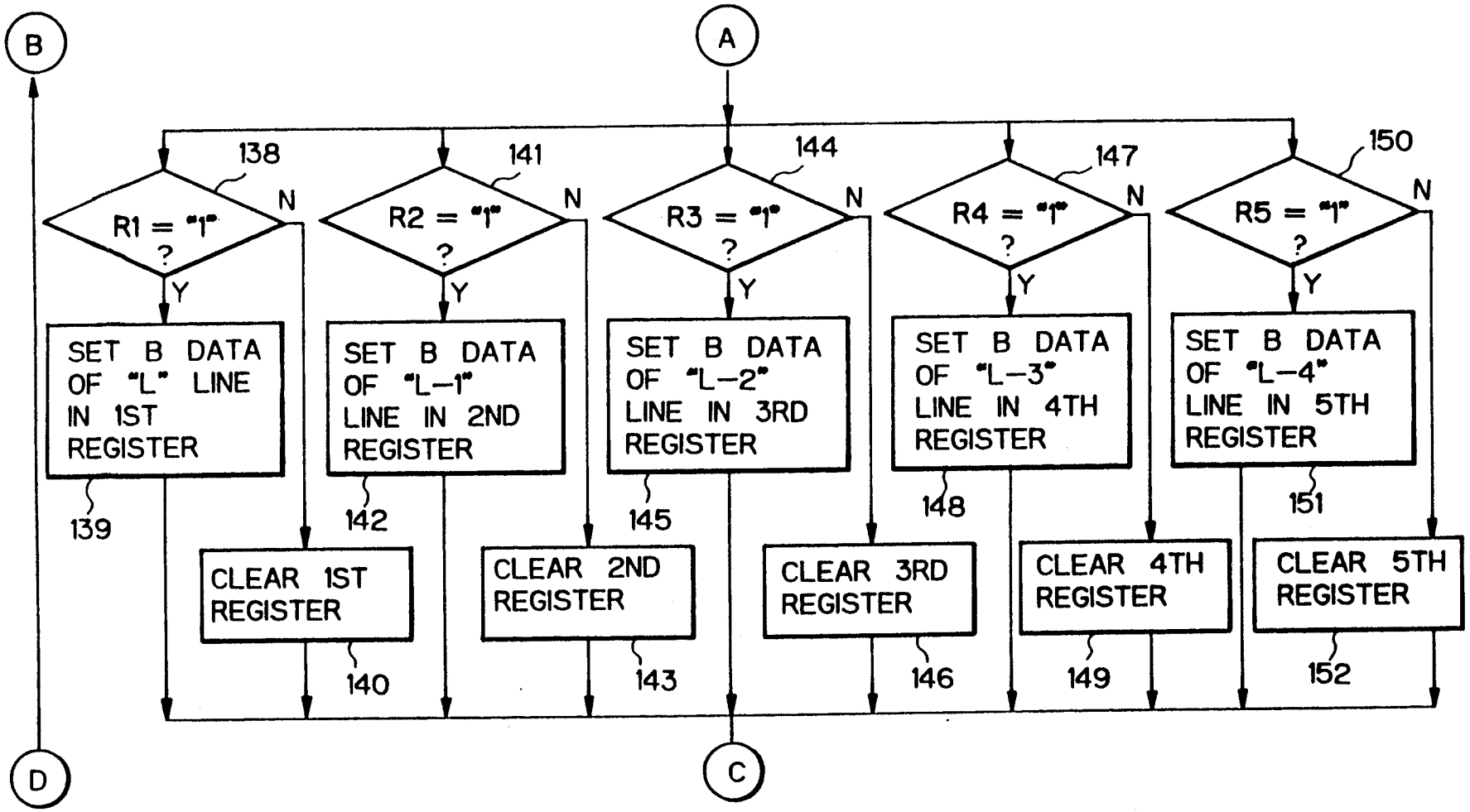

If the first bit R1 of the history register 9 is "1" (138, FIG. 5B), the CPU 14 sets black image data on the "L" line in the first register of the buffer register 7 (139, FIG. 5B); if it is "0", the CPU 14 clears the first register (140, FIG. 5B). If the second bit R2 is "1" (141, FIG. 5B), the CPU 14 sets black image data on the "L−1" line in the second register of the buffer register 7 (142, FIG. 5B); if otherwise, the CPU 14 clears the second register (143, FIG. 5B). If the third bit R3 is "1" (144, FIG. 5B), the CPU 14 writes black image data on the "L−2" line in the third register of the buffer register 7 (145, FIG. 5B); if otherwise, the CPU clears the third register (146, FIG. 5B). If the fourth bit R4 is "1" (147, FIG. 5B), the CPU 14 sets black image data on the "L−3" line in the fourth register of the buffer register 7 (148, FIG. 5B); if otherwise, the CPU 14 clears the fourth register (149, FIG. 5B). Further, if the fifth bit R4 is "1" (150, FIG. 5B), the CPU 14 writes black image data on the "L−4" line in the fifth register of the buffer register 7 (151, FIG. 5B); if otherwise, the CPU 14 clears the fifth buffer register (152, FIG. 5B).

Figure 5C:
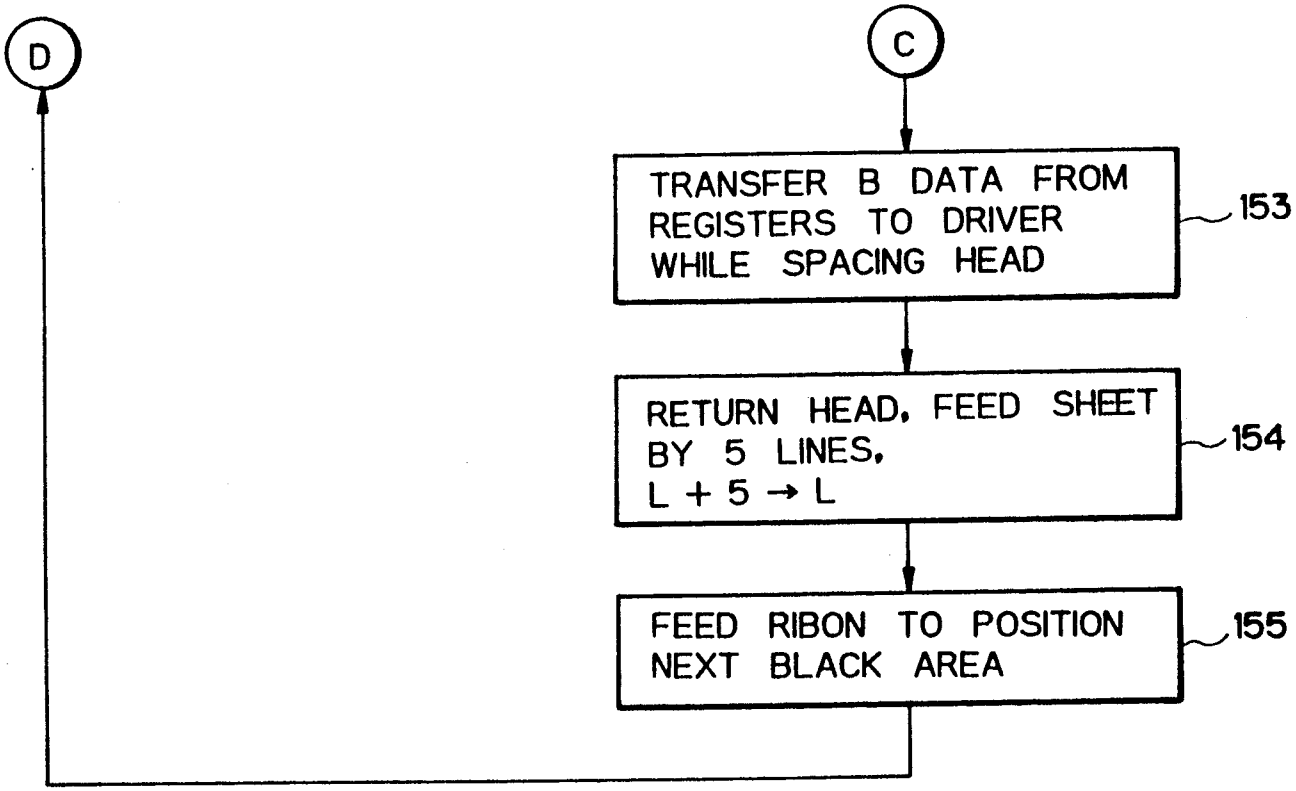

On writing all the black image data in the successive registers of the buffer register 7, the CPU 14 causes the motor controller 10 to drive the spacing motor 11 and, at the same time, sequentially transfers the black image data from the first to fifth registers of the buffer register 7 to the driver 8 (153, FIG. 5C). As a result, while the head 2 is sequentially spaced by the spacing motor 11, the driver 8 selectively drives the heating elements of the head 2 in response to the image data. As a result, the black image data are printed out over five lines on the sheet 1 at a time. Subsequently, the CPU 14 drives the spacing motor 11 and sheet feed motor 12 to return the head 2 to the home position thereof and to feed the sheet 1 by five lines (154, FIG. 5C) and increments the line counter by 5. Further, the CPU 14 drives the ribbon feed motor 13 to transport the ribbon 3 until the next fresh black area 5 reaches the sheet 1 (155, FIG. 5C). Then, the program returns to the step 121, FIG. 5B, for repeating the above-described sequence of steps.

As stated above, in the case of a black printing, the history register 9 is used to memorize which lines should be printed out and to set black image data on the lines of interest in the corresponding registers of the buffer register 7.

Figure 7A:
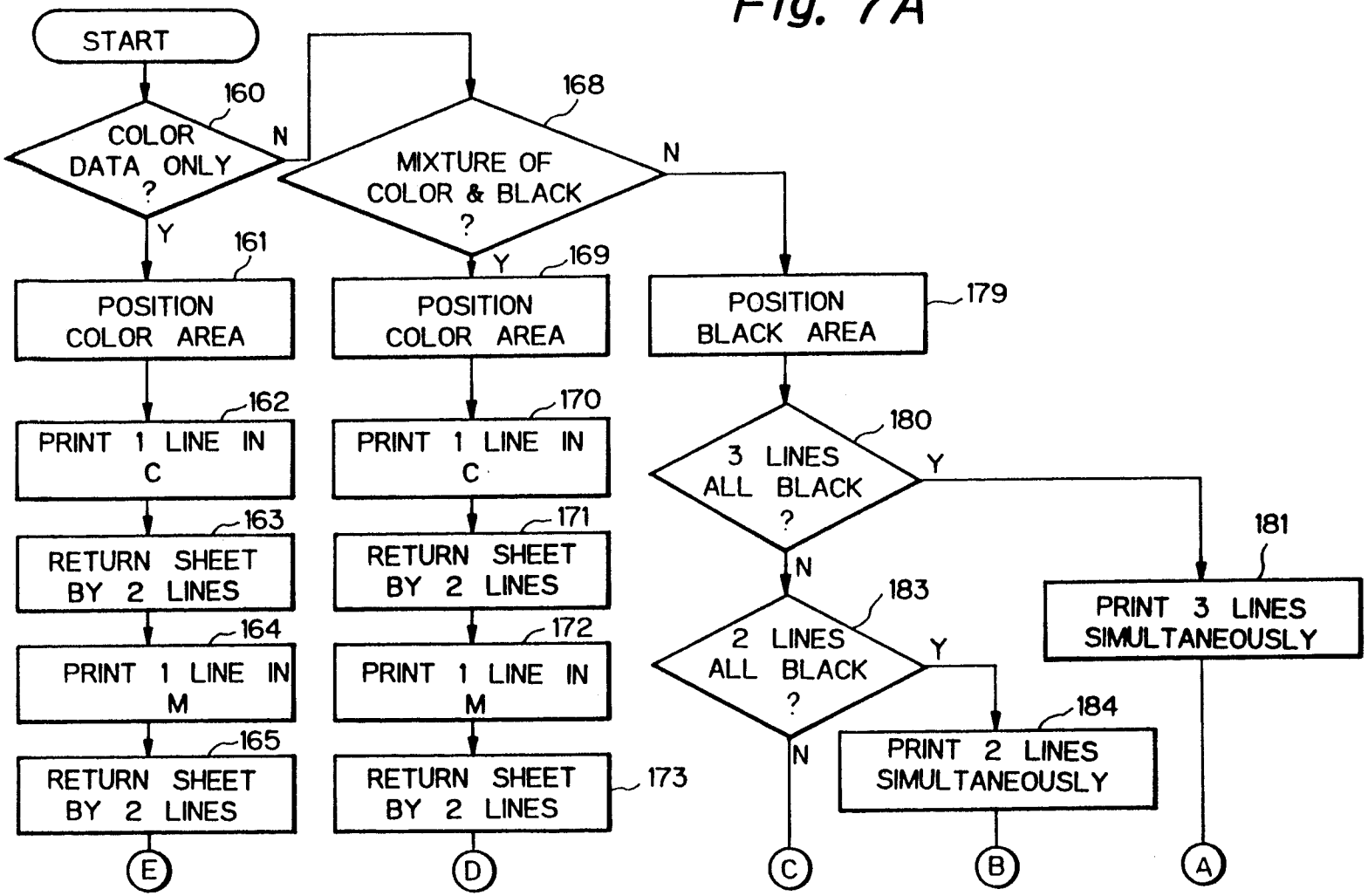
FIGS. 7A and 7B are flowcharts representative of an alternative embodiment of the present invention.
Figure 7B:
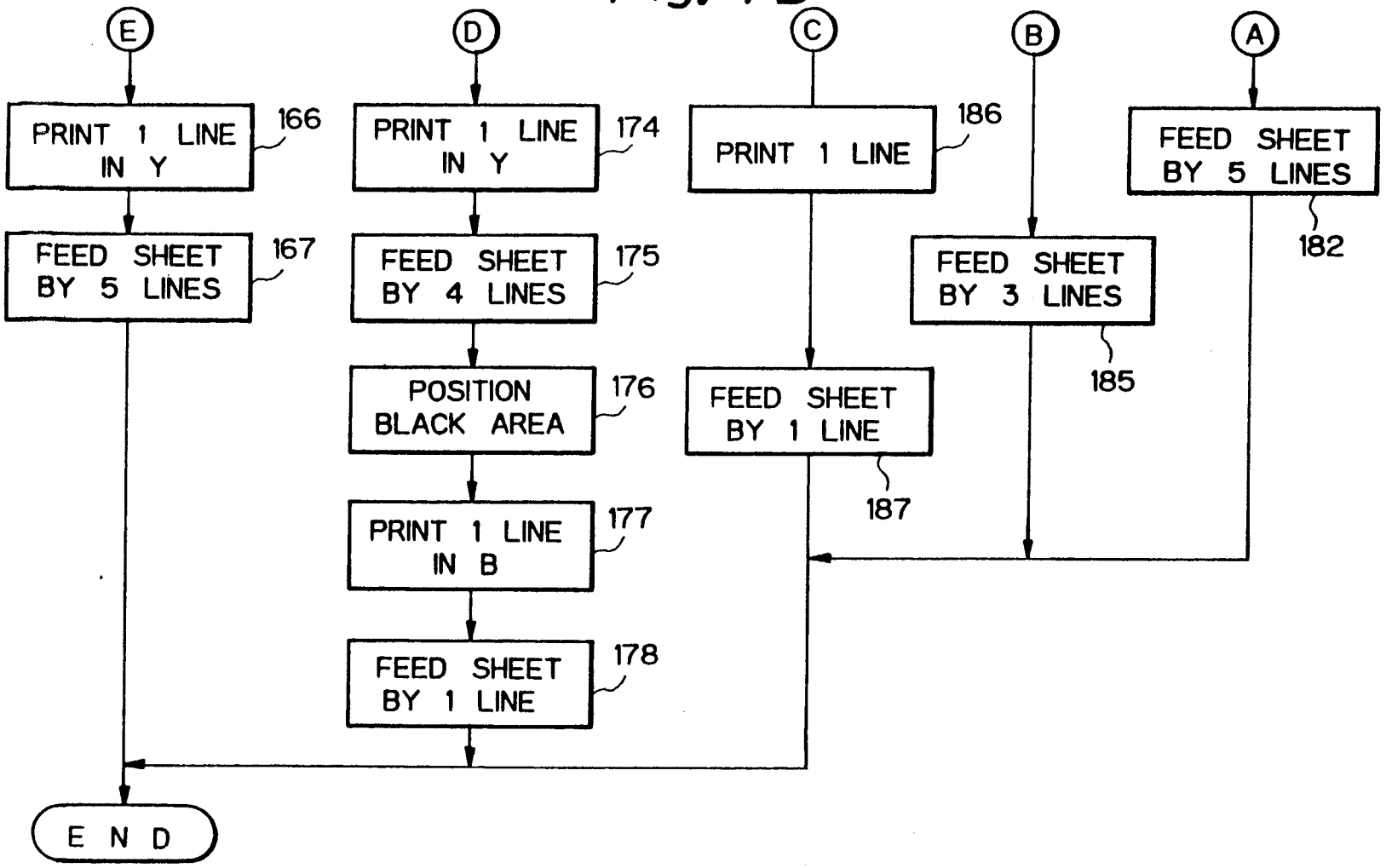

FIGS. 7A and 7B are flowcharts representative of an alternative embodiment of the present invention. While the embodiment described above is adapted to print out either a color image or a black image at a time, the alternative embodiment is capable of selectively printing out only a color image, a combined color and black image or only a black image, as desired. With the specific procedure of FIGS. 7A and 7B, the embodiment prints out a text image on the sheet, FIGS. 1 and 2. First, whether the image data to be printed out is color data, combined color and black data, or black data is determined (160, FIG. 7A). If the image data of interest is color data, the ribbon 3, FIG. 1, is paid out to position a color area 4 thereof in front of the sheet 1 (161, FIG. 7A). In this condition, cyan data is printed on one line (164, FIG. 7A), then the sheet 1 is returned by two lines (163, FIG. 7A), then magenta data is printed on one line (164, FIG. 7A), then the sheet 1 is again returned by two lines (165, FIG. 7A), then yellow data is printed on one line (166, FIG. 7B), and then the sheet 1 is fed by five lines (167, FIG. 7B). Assume that the image data of interest is the combination of color data and black data. In this case, after the ribbon 3 has been transported to position a color area 4 thereof in front of the sheet 1 (169, FIG. 7A), cyan data is printed on one line (170, FIG. 7A), then the sheet 1 is returned by two lines (171, FIG. 7A), then magenta data is printed on one line (172, FIG. 7A), then the sheet 1 is returned by two lines (173, FIG. 7A), then yellow data is printed on one line (174, FIG. 7A), and then the sheet 1 is returned by four lines (175, FIG. 7B). Subsequently, the ribbon 3 is transported to bring a black area 5 into register with the sheet 1 (176, FIG. 7B), then black image is printed on one line (177, FIG. 7B), and then the sheet 1 is returned by one line (178, FIG. 7B). On the other hand, assume that the image data to be printed out is black data. Then, the ribbon 3 is again transported for positioning a black area 5 in front of the sheet 1 (179, FIG. 7A). If all the three lines of data corresponding to the first, third and fifth lines for printing a graphic image are black data (180, FIG. 7A), all the three lines of data are printed (181, FIG. 7A), and then the sheet 1 is fed by five lines (182, FIG. 7B). Likewise, if two lines of data corresponding to the first and third lines for printing a graphic image are black data (183, FIG. 7A), the two lines of data are printed at the same time (184, FIG. 7A), and then the sheet 1 is fed by three lines (185, FIG. 7B). Further, if only one line of data is black, only one line is printed (186, FIG. 7A), and then the sheet 1 is fed by one line (187, FIG. 7A).

In the illustrative embodiment, a color image and a combined color and black image are printed one line at a time while a black image is printed three lines at a time so long as image data exists, whereby rapid printing is promoted. Regarding a color image, the ribbon 3 is not fed until image data has been printed out in three colors.

While this embodiment, like the previous embodiment, has been shown and described in relation to a thermal transfer color printer using a thermal head, it is also practicable with an oil ribbon or similar color ink ribbon and a wire dot print head or similar print head.

In the foregoing embodiments, the head 2 is assumed to have heating elements arranged in five consecutive rows. Alternatively, use may be made of a head having heating elements at positions corresponding only to the previously stated first, third and fifth lines. In such a case, black image data on the first, third and fifth lines and black image data on the second and fourth lines will be printed out independently of each other.

In summary, in accordance with the present invention, a color ink ribbon has color areas and black areas alternating with each other along the length of the ribbon and each having a length greater than the width of a sheet. Each color area is subdivided in width into a plurality of strip-like areas each being impregnated with or coated with ink of particular color, e.g., yellow, magenta or cyan. Each black area is impregnated with or coated with black ink over the entire width thereof. With such a ribbon, it is possible to print out an image on a sheet rapidly in all the colors without feeding the ribbon, i.e., by feeding the sheet only. Since the black areas have a greater width than the color areas, a black image can be printed out continuously or on a plurality of lines at a time without the ribbon being fed and, therefore, at a high speed. In the case of a text image which is, in many cases, printed in black, the ink of the ribbon can be efficiently used.

Further, in accordance with the present invention, a color printer selectively drives the printing elements of a print head while spacing the head so as to transfer ink from the above-stated color ink ribbon to a sheet. The printing elements are arranged over the entire width of the ribbon. The printer, therefore, can print image data of all the colors or only a plurality of lines of black image data at the same time without the ribbon being fed, achieving high speed printing.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A color ink ribbon for use in a serial color printer, comprising:

a ribbon elongated in a longitudinal direction and having a plurality of first and second areas alternately arranged in said longitudinal direction of said ink ribbon;

each of said plurality of first areas being subdivided in a width direction of said ribbon into a plurality of strip-like areas extending in said longitudinal direction, with each of said strip-like areas of a respective said first area being impregnated or coated with ink of a respectively different color which is the same as the color of a corresponding one of said strip-like areas of the other of said first areas in said longitudinal direction; and each of said plurality of second areas being impregnated or coated with black ink over the entire width thereof.

2. A color ink ribbon in accordance with claim 1, wherein each of said plurality of strip-like areas has the same width in said width direction.

3. A color ink ribbon in accordance with claim 2, wherein each of said plurality of strip-like areas has a width sufficient for printing at least one character line.

4. A color ink ribbon in accordance with claim 3, wherein each of said first areas includes three of said strip-like areas which are impregnated or coated respectively with cyan, magenta and yellow ink.

5. A color ink ribbon in accordance with claim 1, wherein each of said plurality of first areas and each of said plurality of second areas is longer than a printing sheet with respect to said longitudinal direction.

6. A serial color printer for printing an image or character on a printing sheet using a color ink ribbon, comprising in combination:

a color ink ribbon having a shape elongated in a first direction in which said ink ribbon is fed and which is substantially perpendicularly to a second direction in which a printing sheet is fed, said color ink ribbon including a plurality of color areas and a plurality of black areas which are alternately arranged on said ink ribbon in the first direction and which are each longer than a printing sheet with respect to the first direction, with each of said plurality of color areas being subdivided in the second direction into a plurality of strip-like areas which extend in the first direction and which are each impregnated or coated with ink of a color different from each other, and with each of said plurality of black areas being impregnated or coated with black ink over the entire area thereof;

a print head mounted adjacent one surface of said ribbon and movable in said first direction, said print head including a plurality of heating elements aligned in said second direction to cover an entire width of said ribbon for printing an image or character on a printing sheet disposed adjacent an opposite surface of said ink ribbon;

a sheet feed means for feeding a printing sheet in said second direction;

a ribbon feed means for feeding said ink ribbon in said first direction; and control means for controlling said print head, said sheet feed means and said ribbon feed means and for selectively driving said heating elements in response to print data fed from a host connected to said printer to thereby transfer colored or black ink from said ribbon onto a printing sheet.

7. A printer in accordance with claim 6, wherein three of said strip-like areas are provided in each of said color areas and are impregnated or coated respectively with cyan, magenta and yellow ink.

8. A printer in accordance with claim 7, wherein said color ink ribbon has a width in said second direction sufficient for printing at least three character lines simultaneously and said control means selectively controls said heating elements to print simultaneously with respective colors for three character lines.

* * * * *